US005421272A

United States Patent [19]

Wilmore

[11] Patent Number: 5,421,272

[45] Date of Patent: Jun. 6, 1995

[54] FOLDING TABLE

[75] Inventor: James K. Wilmore, Gallatin, Tenn.

[73] Assignee: Globe Business Furniture, Inc., Hendersonville, Tenn.

[21] Appl. No.: 107,605

[22] Filed: Aug. 18, 1993

Related U.S. Application Data

[63] Continuation-in-part of Ser. No. 979,319, Nov. 20, 1992, Pat. No. 5,357,872.

[51] Int. Cl.[6] ..... A47B 3/00

[52] U.S. Cl. ..... 108/115; 108/168; 16/321

[58] Field of Search ..... 108/115, 168, 172; 292/278, 270; 16/231, 321, 333

[56] References Cited

U.S. PATENT DOCUMENTS

| | | | |
|---|---|---|---|
| 677,442 | 7/1901 | Eames . | |
| 2,540,849 | 2/1951 | Walker . | |
| 2,643,926 | 6/1953 | Pucci . | |
| 2,723,890 | 11/1955 | Erickson | 108/115 |
| 2,747,957 | 2/1954 | Lencioni . | |
| 2,903,313 | 9/1959 | Block | 108/35 |
| 3,368,504 | 6/1967 | Cohen . | |
| 3,421,459 | 1/1969 | Sherwood . | |
| 3,869,158 | 3/1975 | Ciciulla | 292/278 |
| 4,341,164 | 7/1982 | Johnson . | |
| 4,826,244 | 5/1989 | Choi | 108/35 |
| 4,841,877 | 6/1989 | Virtue . | |
| 5,029,938 | 7/1991 | Song | 108/35 |

FOREIGN PATENT DOCUMENTS

| | | | |
|---|---|---|---|
| 176955 | 4/1986 | European Pat. Off. | 108/115 |
| 394500 | of 0000 | France | 292/270 |
| 451433 | 5/1968 | Switzerland | 108/115 |
| 22561 | of 1891 | United Kingdom | 108/36 |
| 476643 | 12/1937 | United Kingdom | 108/115 |
| 2181658 | 4/1987 | United Kingdom | 108/35 |

*Primary Examiner*—Michael J. Milano

*Attorney, Agent, or Firm*—Jacobson, Price, Holman & Stern

[57] ABSTRACT

A folding table has table top halves of molded plastic which are hinged together along a transverse center line of the table. The table top halves have integral moldings for fitting folding metal legs as well as telescopic longitudinal metal reinforcing bars and transverse reinforcing bars held in place by the longitudinal reinforcing bars. The table has a unique carrying handle arrangement and latching assemblies for holding the table top halves in an open position.

3 Claims, 15 Drawing Sheets

FOLDING TABLE

REFERENCE TO RELATED APPLICATION

This application is a continuation-in-part of application Ser. No. 07/979,319, filed Nov. 20, 1992, now U.S. Pat. No. 5,357,872, and the contents of which is expressly incorporated herein by reference.

BACKGROUND OF THE INVENTION

This invention relates to a folding table of the kind having a table top formed by two table top halves hinged to each other along the center line of the table for folding together in the manner of a case, when the table is to be transported or stored, and for unfolding into a coplanar disposition to form the table top when the table is to be used. Each table top half, on its undersurface, carries a hinged leg assembly which can be positioned substantially flat against the undersurface when the table is folded and can swing out into an upright position to support the table top when the table is unfolded.

Folding tables of this kind should meet various requirements and the prior art is replete with different designs. For example, the table should be simple to unfold for setting up, and to fold for taking down. It should be as light in weight as possible, consistent with having sufficient rigidity when unfolded. These requirements are particularly important where, for example, the table is for use as a banquet table, and large numbers of such tables need to be set up and taken down at one time. Also, the table should be simple and economical to manufacture and should be simple and compact to transport and store.

It is an object of the present invention to provide a folding table of the kind described which, to a large extent, meets the above requirements.

SUMMARY OF THE INVENTION

In a folding table according to the invention, the table top halves are conveniently made of injection molded plastic with ribs on the undersurface and various molded recesses and fittings for attaching and receiving parts of the table hardware such as hinges for the table top, folding legs, supports for rigidifying the table top in use, and a carrying handle, any one or more of which parts may be made of metal.

In one embodiment of the invention, a novel form of carrying handle is mounted on the hinge line between the table top halves, so as to be exposed for use when the table is folded and be hidden between the table top halves when they are unfolded. Preferably, for example, the table top halves are interconnected by a pair of hinges having a common hinge pin which, in its center portion, forms the carrying handle.

Another aspect of this embodiment resides in the provision of longitudinal telescopic support assemblies on the undersurface of the table top halves including male telescopic elements which are extended from respective tubular elements in one of the table top halves across the hinge line between the halves when the table is unfolded, and into further tubular elements on the other table top half to support and rigidify the table top. Conveniently, the tubular elements on the respective table top halves may fit over and lock in place transversely extending metal support bars which fit in molded transverse channels on the undersurfaces of the table top halves adjacent the hinge line. The transversely extending metal support bars may themselves fit over and lock in place projecting flanges on the hinges which attach the table top halves together, the hinges themselves being located in shallow pockets or the like formed in side walls of the transverse channels. With this arrangement, during assembly of the table, the hinge elements and transverse support bars can be fitted to the table top halves without the need for additional fasteners, and only the longitudinal tubular elements need be attached by fasteners, such as screws and brackets, to the respective table top halves.

Still another feature of the first embodiment resides in a snap over toggle-type latch arrangement which fits over the respective transverse support bars to further rigidify the table top when it is open and ensure a close fit of the table top halves along the hinge line.

In a second embodiment of the invention, the table top halves include longitudinal tubular bracing elements which again fit over and lock in place transversely extending metal support bars fitting in molded transverse channels as in the first embodiment. In this embodiment, however, there are no telescopic elements as in the previous embodiment and the hinge and handle structures are also modified. Thus, in the second embodiment, the hinges are welded directly to the longitudinal bracing elements, and the handle structure comprises a pair of slide-out handles of plastic material carried by the respective longitudinal bracing elements. The handles can slide out from the sides of the respective table top halves when these are folded and back in when the table is unfolded. Also, the handles are designed to nest one within the other when moved out for carrying to enhance carrying comfort.

Another feature of the second embodiment, is the provision of a spring-loaded lever-type latch carried by a hinge plate on one of the table top halves adjacent the hinge line, for snapping into engagement with a latch-receiving formation in the adjacent hinge plate on the other table top half when the table is opened and latching the table in the open position.

Additional features and advantages of the invention will be apparent from the ensuing description and claims read in conjunction with the attached drawings.

DESCRIPTION OF PREFERRED EMBODIMENT

Figure 1:
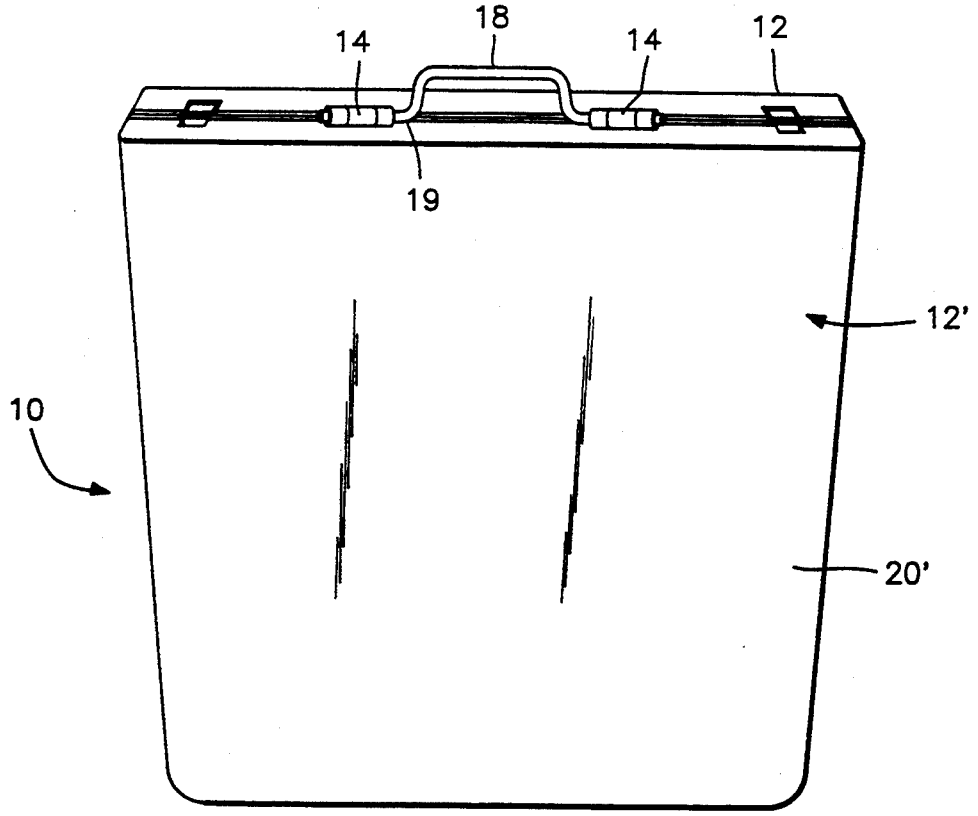
FIG. 1 is a perspective view of a first embodiment folding table, showing the same in its folded position for carrying.
Figure 2:
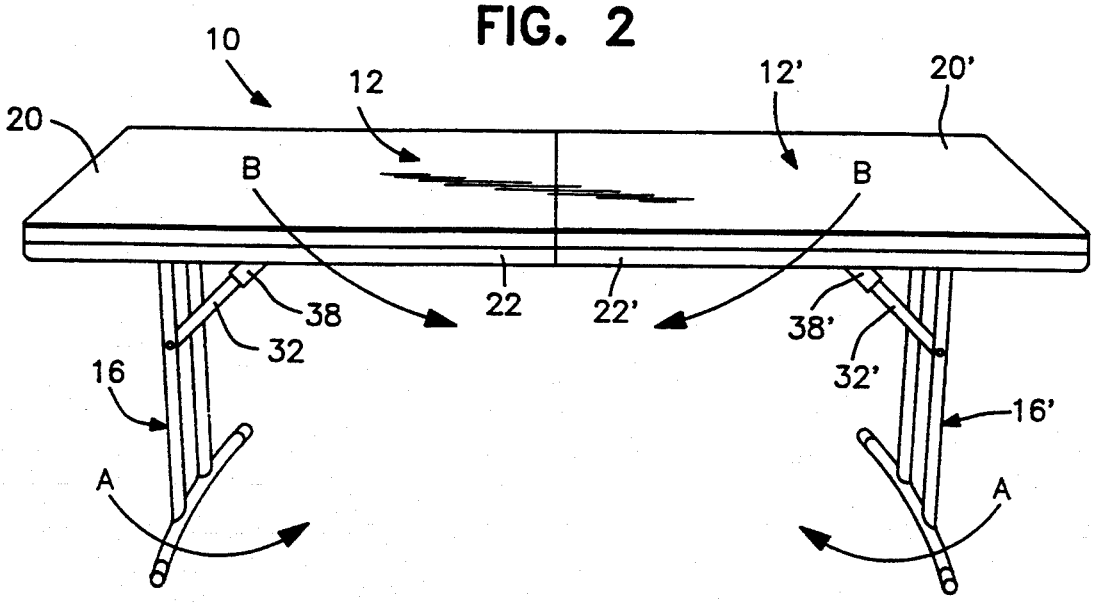
FIG. 2 is a perspective view of the table in the unfolded assembled position.

A first embodiment folding table 10 according to the invention can be readily converted as between a folded condition shown in FIG. 1, for transport and storage, and an unfolded assembled position, shown in FIG. 2, for use of the table. The table has molded plastic left and right hand table top halves 12, 12' which are hinged together, generally along a transverse center line of the table by hinge assemblies 14, and the table top halves are provided with respective fold-out leg assemblies 16,16'. From the unfolded assembled position shown in FIG. 2, the leg assemblies can be collapsed against the undersurface of the respective table top halves by pivoting the legs as indicated by arrows A, and the table top halves can then be folded together about the hinge assemblies in the direction of arrows B, in the manner of a case, to convert the table to the transport and storage condition shown in FIG. 1. Also, as evident in FIG. 1, handle 18, which is formed by a common hinge pin 19 connected between the assemblies 14, becomes exposed for readily carrying the table when it is folded. It is evident that to convert the table to its unfolded assembled condition, the above operations are reversed. In the unfolded condition, handle 18 is concealed between the table top halves at the center line of the table.

Figure 3:
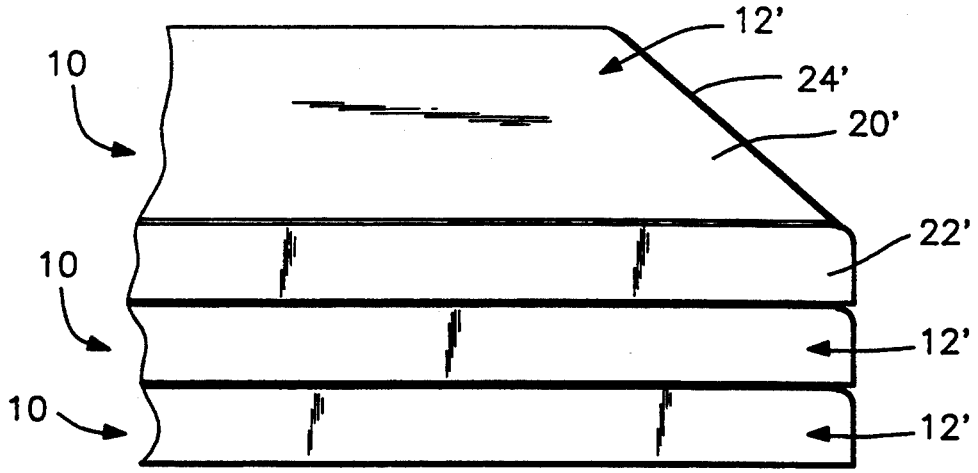
FIG. 3 is a partial view showing a plurality of tables according to the invention nested for storage.

Each of the table top halves 12 and 12' is in the form of a shallow tray or dish-like plastic molding having a top wall 20 or 20' with a depending peripheral flange 22 or 22'. Also, the table top halves may have peripherally extending ridges 24 or 24' or other formations allowing plural tables to be nested and stacked as shown in FIG. 3. Internally, each table top half provided with a latticework of longitudinal and transverse molded reinforcing ribs 26, 26' which are about half the height of the peripheral flanges 22, 22'.

Figure 13:
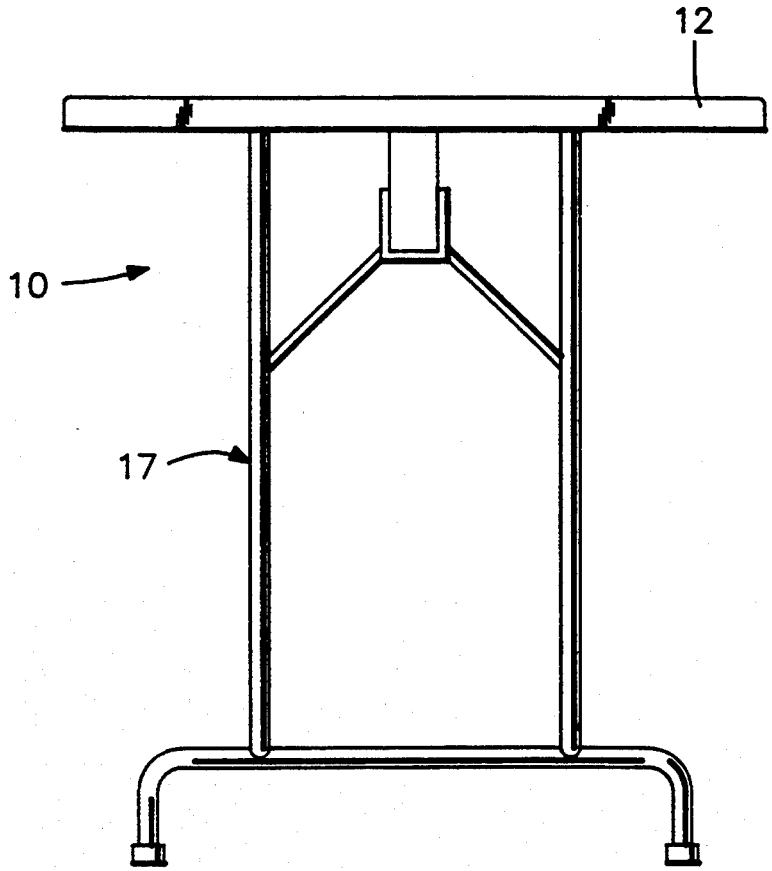
FIG. 13 is an end elevational view of the table, showing a different form of leg element.
Figure 8:
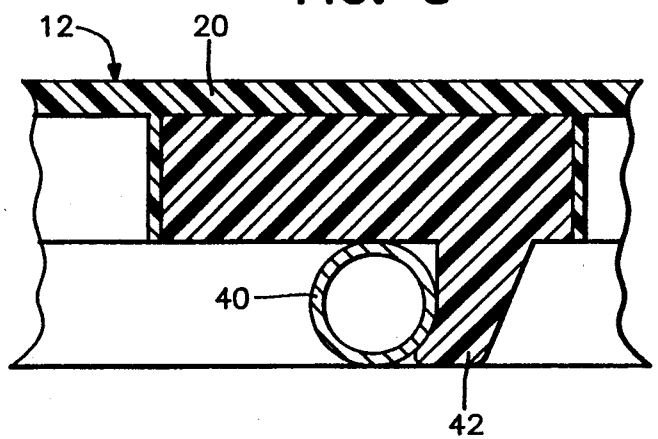
FIG. 8 is an enlarged cross-sectional view on line 8—8 of FIG. 4, showing in detail a locking means for holding the legs in their unfolded position.
Figure 7:
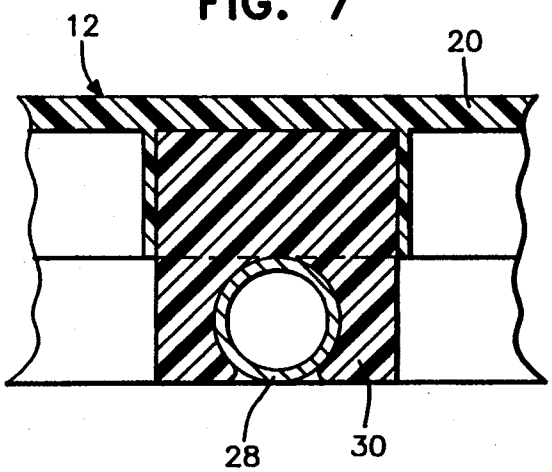
FIG. 7 is an enlarged cross-sectional view on line 7—7 of FIG. 4, showing an integral hinge support for the folding legs.
Figure 6A:
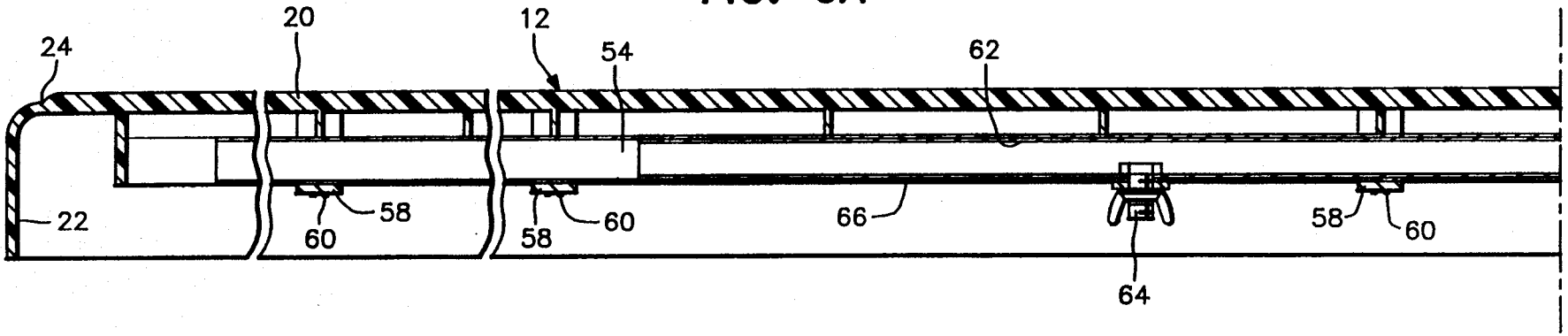
FIGS. 6A & 6B are longitudinal cross-sectional views through telescoping locking elements taken along lines 6A—6A and 6B—6B of FIG. 4, respectively.
Figure 6B:
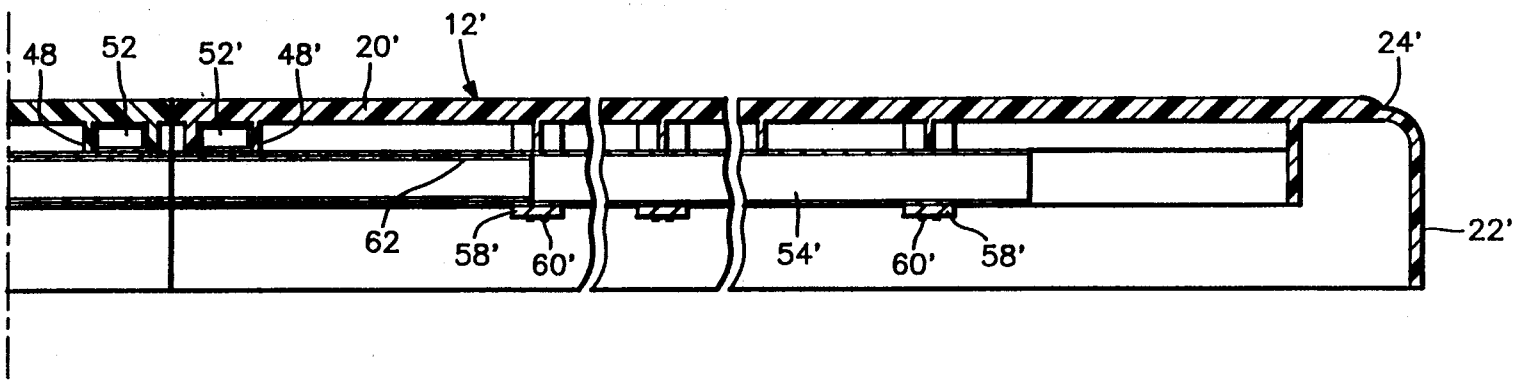

The leg assemblies 16, 16' have respective cross-bars 28, 28' by which they are pivoted to the table top halves. For example, the cross-bars may pivotally snap-fit into respective journals 30, 30 (FIG. 7) molded with the table top halves. To releasably lock the leg assemblies in the open position shown in FIG. 2, the leg assemblies have lockable bracing links 32, 32', pivotally connected to support links 34, 34' which are themselves pivotally attached to support pads 36, 36' screwed or otherwise suitably attached to molded plate sections on the undersurfaces of the table top halves. Slidable locking sleeves 38, 38' are provided to fit over the joint between the links 32, 32' and 34, 34' for releasably locking the leg assemblies in the open position. The leg assemblies may include base bars 40, 40' which may snap fit into retainers 42, 42' (FIG. 8) molded with the table top halves. An alternative configuration of leg assembly 17 is shown in FIG. 13.

Figure 5:
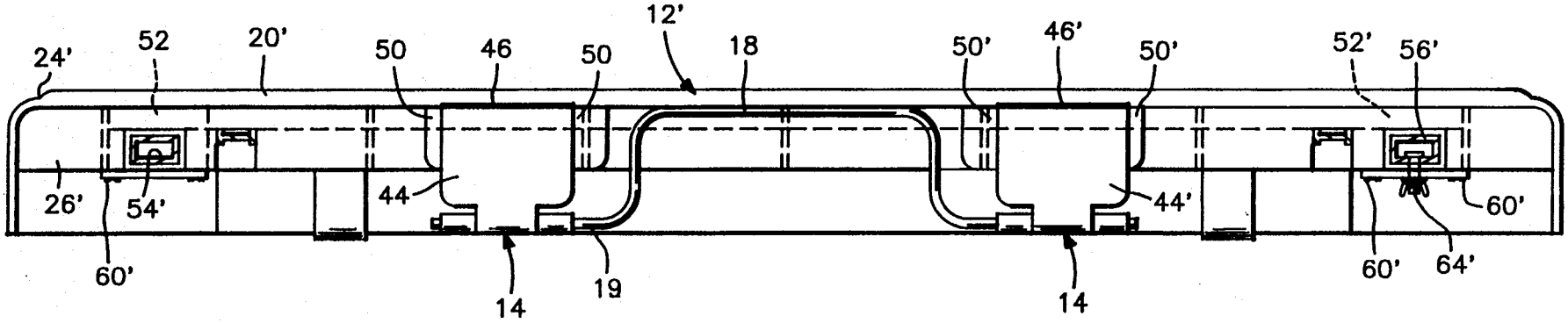
FIG. 5 is a transverse cross-sectional view on line 5—5 of FIG. 4.
Figure 12:
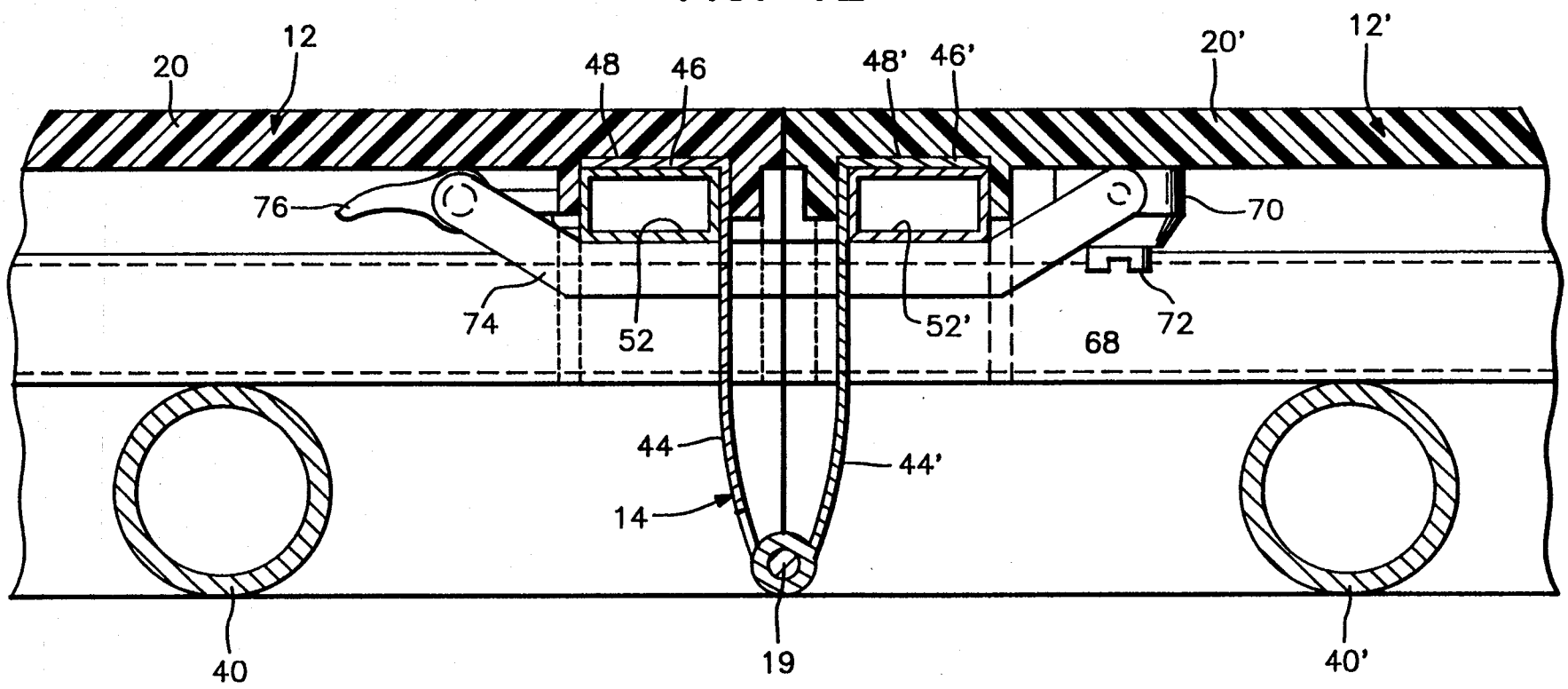
FIG. 12 is an enlarged cross-sectional view on line 12—12 of FIG. 4.

The hinge assemblies 14 include respective hinge plates 44, 44' connected by the hinge pin 19 and perpendicular flanges 46, 46' at the bottom of the hinge plates (see particularly FIG. 12). The table top halves are formed with molded transverse channels 48, 48' adjacent their inner edges and the hinge plates 44, 44' locate in pockets 50, 50' on the inner channel wall with the flanges located on the bases of the respective channels. Transverse metal reinforcing bars 52, 52' fit in the channels over the flanges to hold the hinge assemblies in place and also to rigidify the table top. As evident in FIG. 5, when the table top is open the pivot axis of the hinge assemblies, as defined by hinge pin 19, is below the upper surface of the table top, whereby the handle 18 is concealed between the table top halves.

The reinforcing bars 52, 52' are themselves held in place at their opposite ends by longitudinally extending tubular members 54, 54' and 56, 56' forming respective female elements of telescopic table reinforcing bar assemblies and the inner ends of which fit over the opposite end of bars 52, 52'. The tubular members are secured to the respective table top halves with straps or brackets 58, 58' and screws 60, 60' fitting in molded sockets or the like in the table top halves. The screws thus effectively constitute the only fasteners needed to secure the longitudinal reinforcing bar assemblies as well as the transverse reinforcing bars and hinge assemblies to the table top halves. The longitudinal reinforcing bar assemblies further include male longitudinal reinforcing bars 62, 62' slidably received in the respective tubular members 54, 56' for extending movements into the tubular members 54, 56 when the table top is opened out to provide longitudinal bracing of the table top, and for retracting movements back into the tubular members 54, 56' when the table is to be folded for transport and storage. The bars 62, 62' carry screw and wing nut assemblies 64, 64' which travel in slots 66, 66' in the tubular members 54, 56' which allow the bars 62, 62' to be locked in both the extended and retracted positions, while the length of the slots define the length of travel of the bars. As illustrated, the tubular members 54, 54' carrying the bars 62, 62' are on the opposite table top halves, however they may, alternatively, be on the same table top half.

Figure 4:
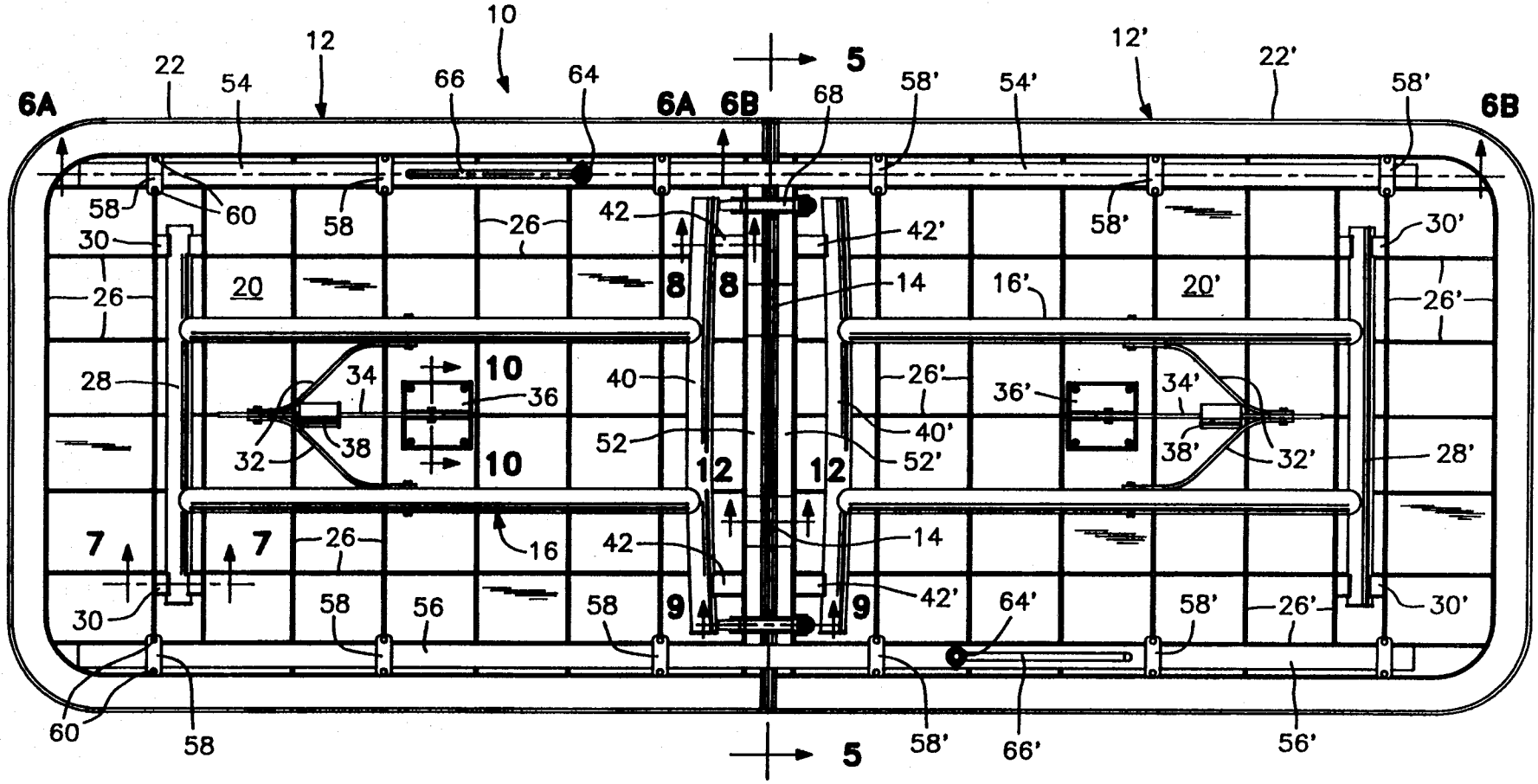
FIG. 4 is a bottom plan view of the table unfolded and with the legs collapsed.
Figure 9:
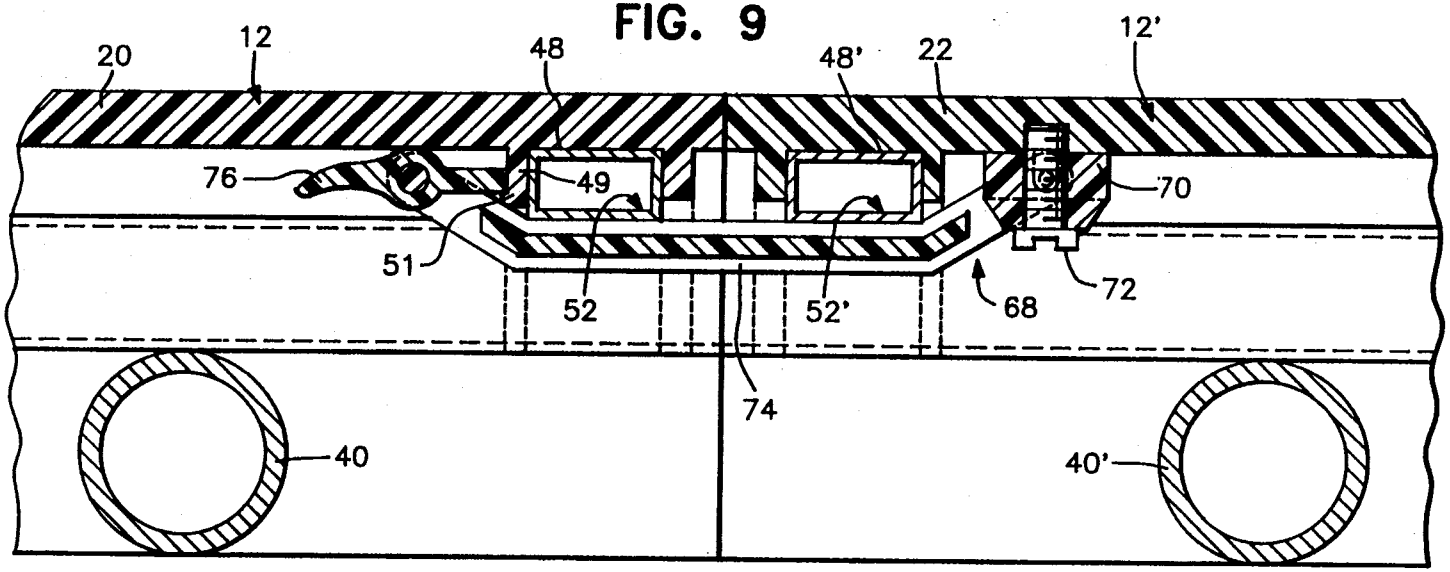
FIG. 9 is an enlarged cross-sectional view on line 9—9 of FIG. 4 and illustrating a snap-over-center latching means to provide the table with rigidity in its unfolded assembled position.
Figure 10:
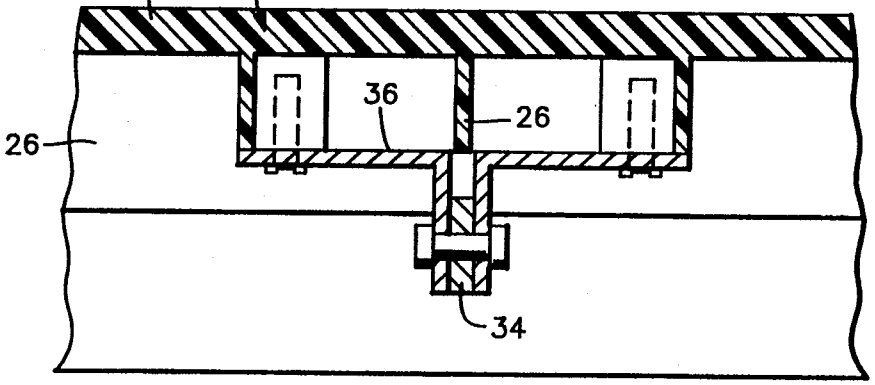
FIG. 10 is an enlarged cross-sectional view on line 10—10 of FIG. 4, showing a pivotal connection of a support for the folding legs to the underside of the table.
Figure 11A:
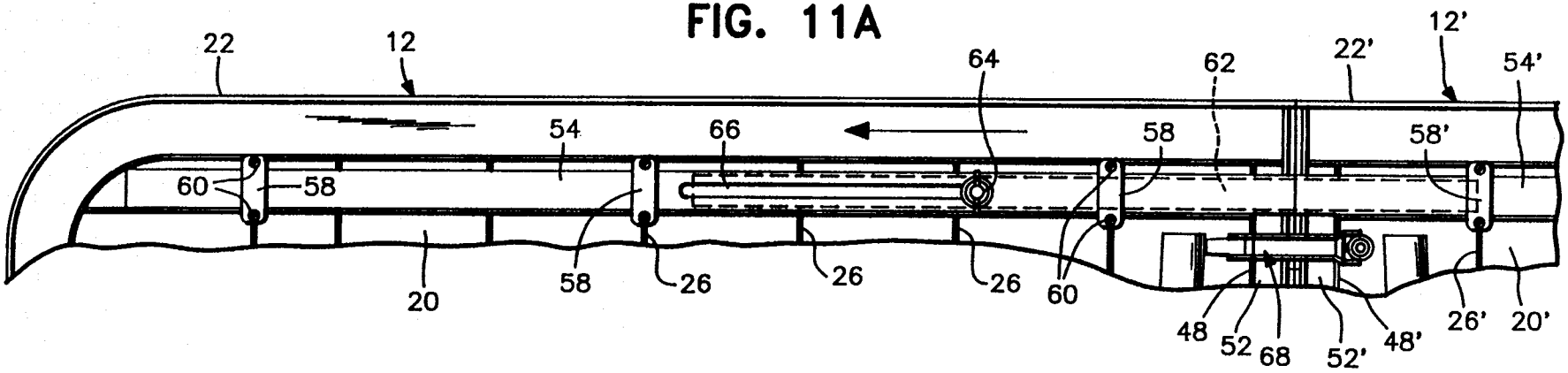
FIG. 11A & 11B are, respectively, views of a telescoping locking element in its locking position and in its withdrawn position.
Figure 11B:
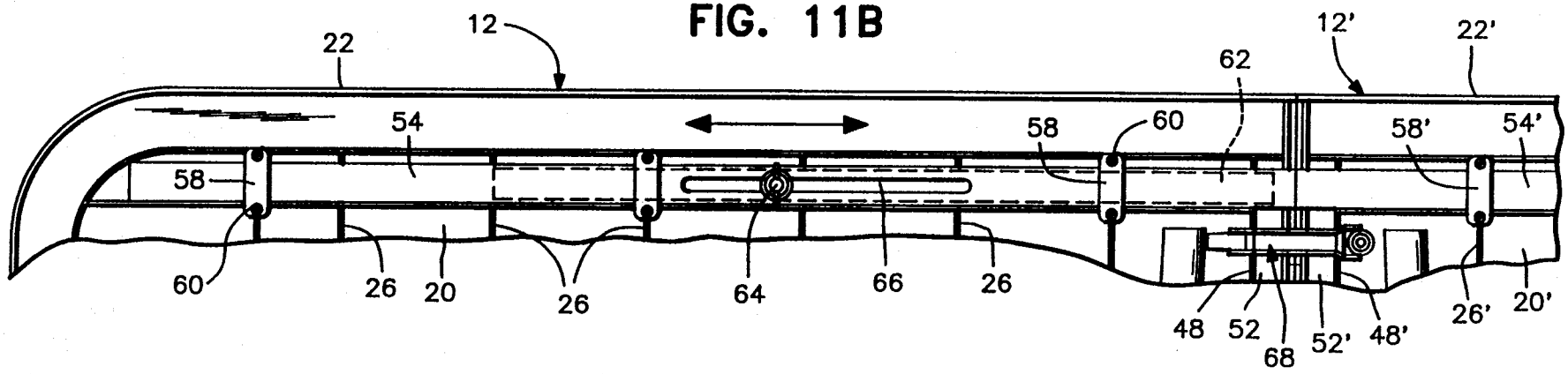

As shown in FIGS. 4 and 9, the table may include latch assemblies 68, for locking over the transverse reinforcing bars 52, 52' to further rigidify the table top when it is open and ensure that the table top halves fit closely together at the transverse center-line of the table. The latch assemblies comprise hubs 70, attached to table top half 12' by screws 72, arms 74, pivotally secured to the hubs, and pivotal toggle links 76, at the ends of the arms. When the table is open, the arms swing across the reinforcing bars 52, 52' and the links 76, are engaged behind the outer walls 49, of channel 48, which may be provided with a catch retaining lip 51, for this purpose.

It is evident from the above that the invention provides a folding table which is simple and economical to manufacture. When assembling the structure, the only fasteners required are the screws for the longitudinal reinforcing bar assemblies, the screws for the folding leg pads, and the screws for the latch assemblies. All the remaining parts of the table hardware simply fit into suitable receiving formations molded into the table top halves. Further, the table is convenient to transport by means of the handle which is exposed only when the table is folded, and storage of plural tables is facilitated by the nesting and stacking configuration. The table is simple to set up and take down by suitably pivoting the leg assemblies, sliding and locking in place the longitudinal reinforcing bars and manipulating the latch assemblies. Also, in the open position, the molded plastic table top is rigidified and reinforced by the longitudinal and transverse reinforcing bars and the latch assemblies.

Figure 14:
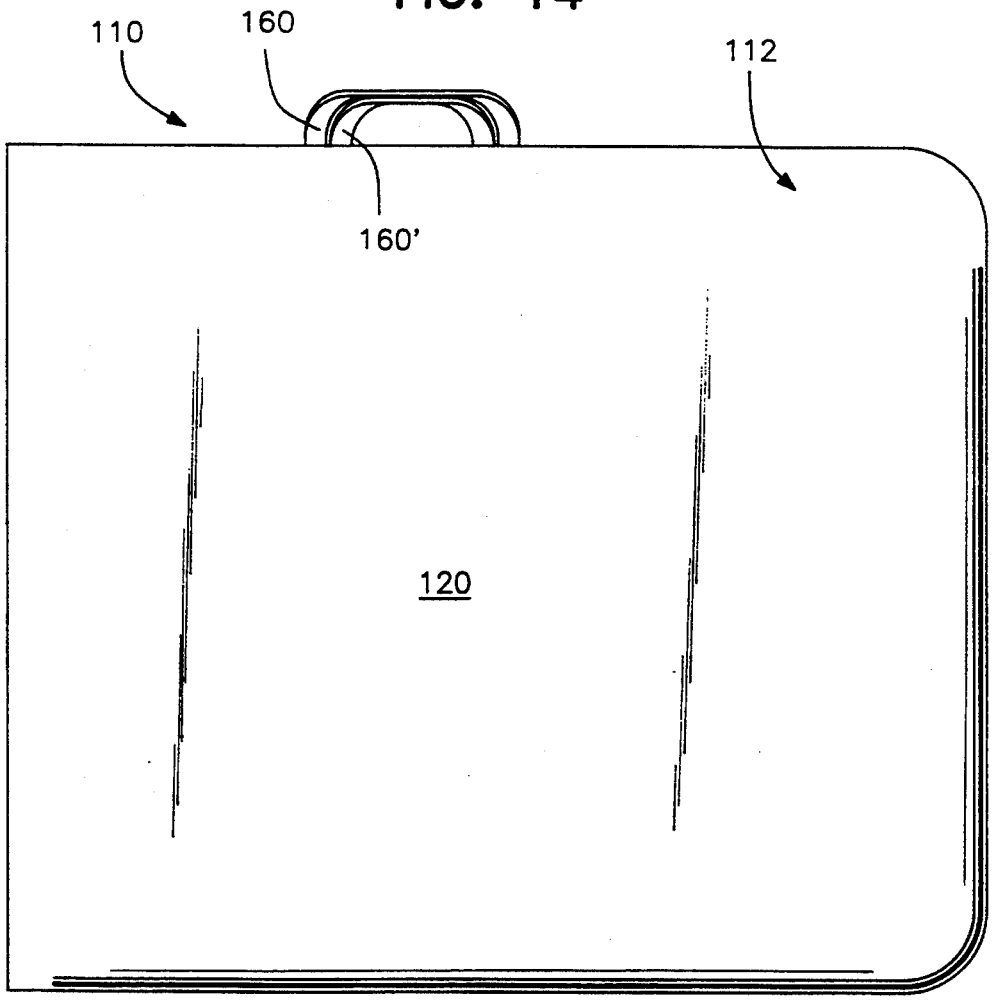
FIG. 14 is an elevational view of a second embodiment folding table according to the invention, showing same in its folded position for carrying.
Figure 20:
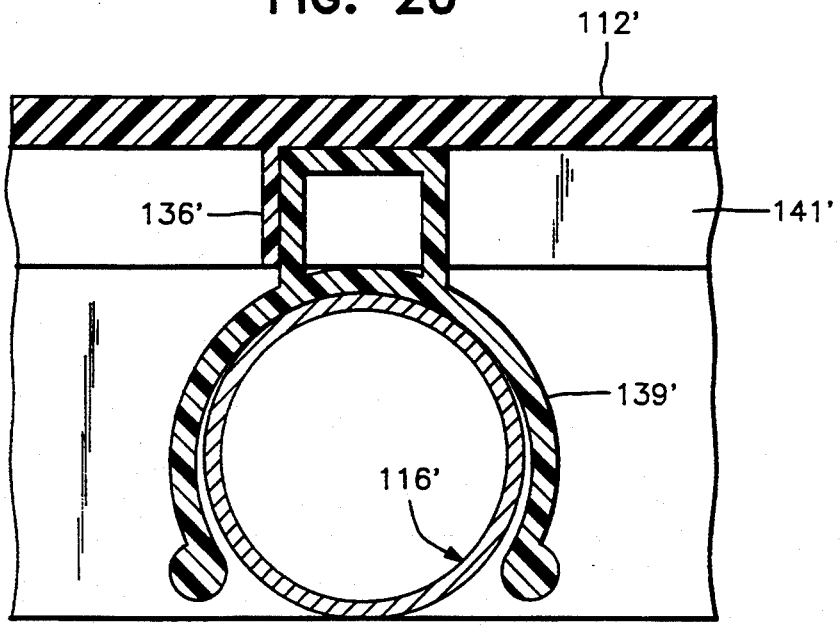
FIG. 20 is an enlarged sectional view on line 20—20 of FIG. 15.

A second embodiment folding table 110 according to the invention, as shown in FIGS. 14 to 21, is generally similar in construction and use to table 10 previously described, and can be readily converted between a folded carrying position shown in FIGS. 14 and 21, and an unfolded position shown in the remaining figures. The table again has molded plastic left and right hand table top halves 112, 112' which are hinged together along a transverse center line of the table by hinge assemblies 114, 114' and the table top halves are again provided with fold-out leg assemblies 116, 116' for folding and unfolding in like manner to the first embodiment table.

Again, each of the table top halves 112 and 112' is in the form of a shallow tray or dish-like plastic molding having a top wall 120 or 120' with a depending peripheral flange 122 or 122', and an internal lattice work of longitudinal and transverse molded reinforcing ribs 126, 126'.

The leg assemblies 116, 116' have respective cross-bars 128, 128' by which they are pivoted to the table top halves, again snap-fitting into respective journals defined by spaced ribs 130, 130' molded with the respective table top halves. In this case, the cross-bars also fit through molded caps 131, 131' fitted in the respective journals. Caps 131 have projections 133 and caps 131' have complimentary grooves 133' (FIGS. 18 and 19) which receive the projections with a snap-fit when the table is closed. Also, the cross-bars 128 have pins or plugs 129, 129' to locate the legs laterally between the respective journals and prevent lateral displacement. To releasably lock the leg assemblies in the open position they again have lockable bracing links 132, 132' pivotally connected to support links 134, 134' themselves pivotally attached to support pads 136, 136' secured as previously to the table top halves. Slideable locking sleeves are again provided. In this case, the legs when folded closed, snap fit into plastic clips 139 139' having bases which are trapped beneath transverse metal bracing bars 141, 141'. The relevant reinforcing ribs 126, 126 have gaps to receive the bars. The legs have outer end cross-bars 140, 140' as previously.

Figure 17:
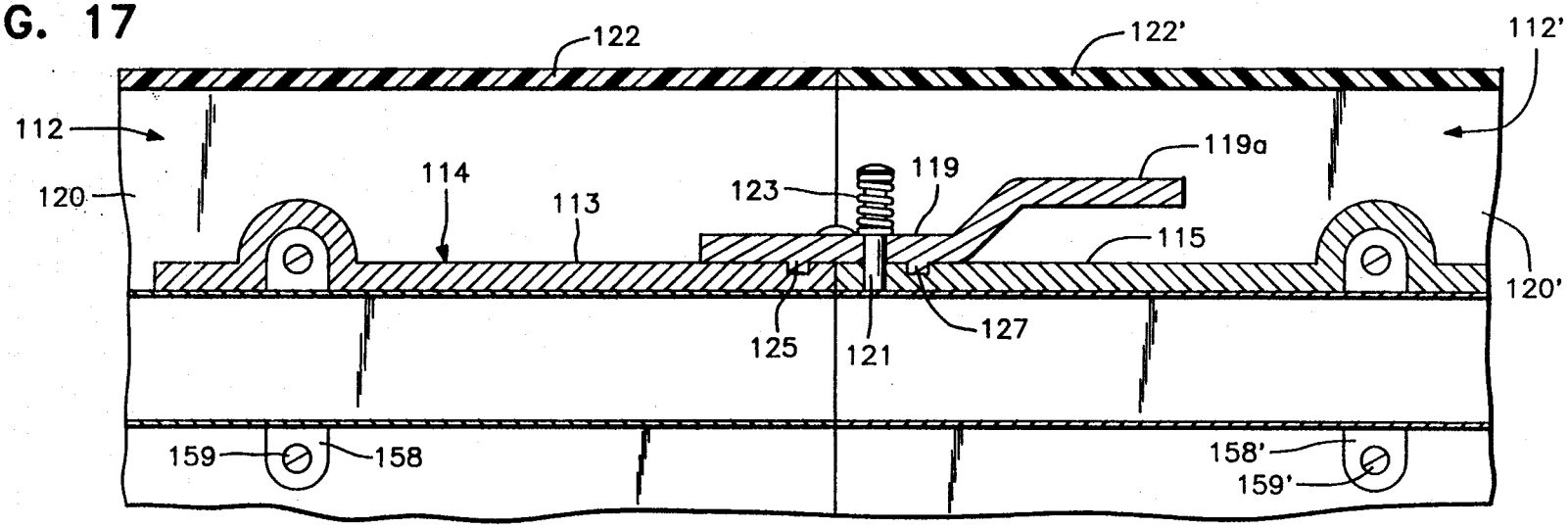
FIG. 17 is a sectional view on line 17—17 of FIG. 16.
Figure 17A:
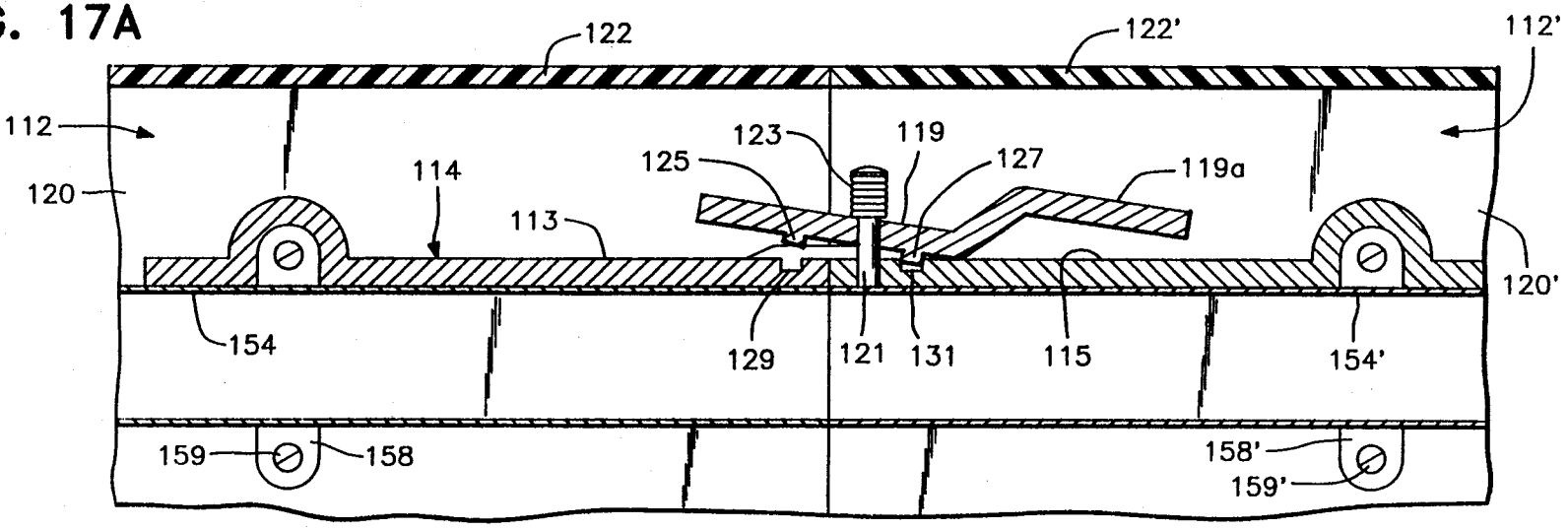
FIG. 17A is a similar sectional view on line 17A—17A of FIG. 16A.
Figure 18:
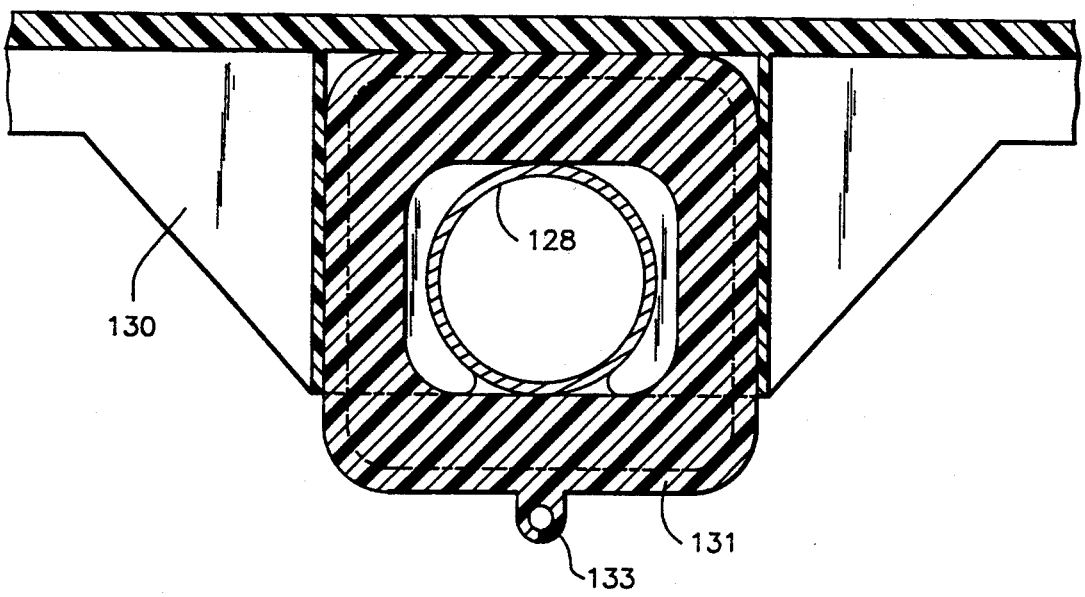
FIG. 18 is an enlarged sectional view on line 18—18 of FIG. 15.
Figure 19:
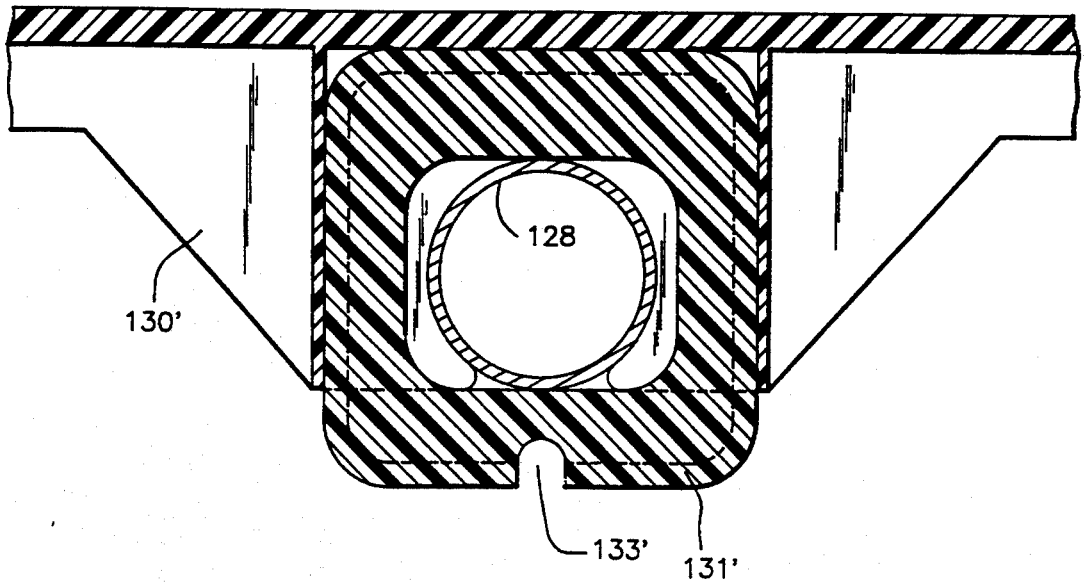
FIG. 19 is an enlarged sectional view on line 19—19 of FIG. 15.

As in the previous embodiment, the table top halves are fitted with longitudinal tubular steel reinforcing bars 154, 154' and 156, 156' secured by straps 158, 158' and screws 159, 159' to the undersurface thereof. There are no telescoping elements, however, and the inner ends of the longitudinal bars are connected to the hinge assemblies 114, 114'. Thus, the hinge assemblies have respective hinge plates 113, 115 and 113', 115' welded to the respective reinforcing bars and connected by hinge pins 117, 117'. As best seen in FIGS. 17 and 17A, the hinge plates are recessed to accomodate the innermost straps 158, 158' and their fittings.

Figure 15:
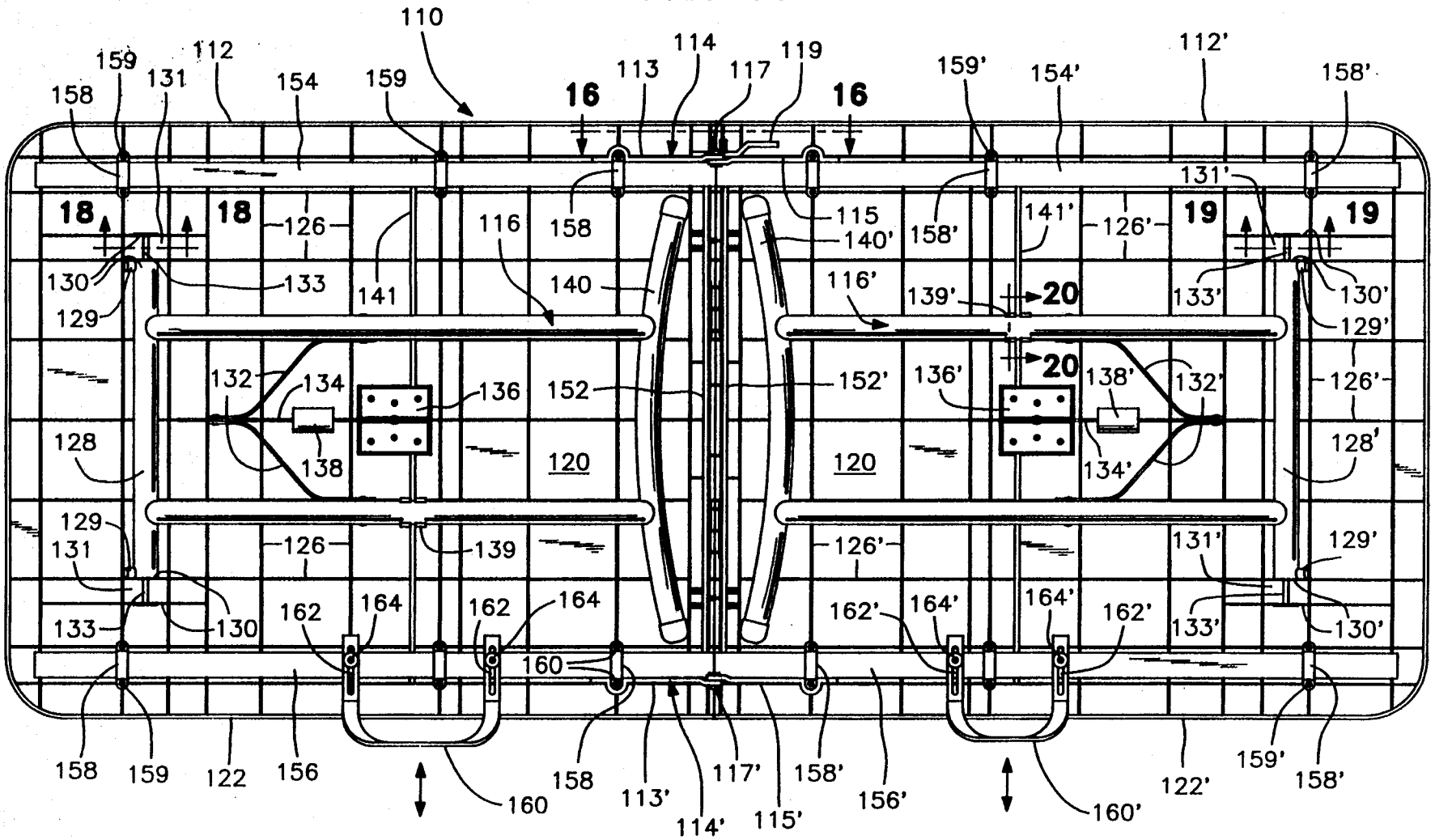
FIG. 15 is an underneath plan view of the second embodiment table when unfolded.
Figure 16:
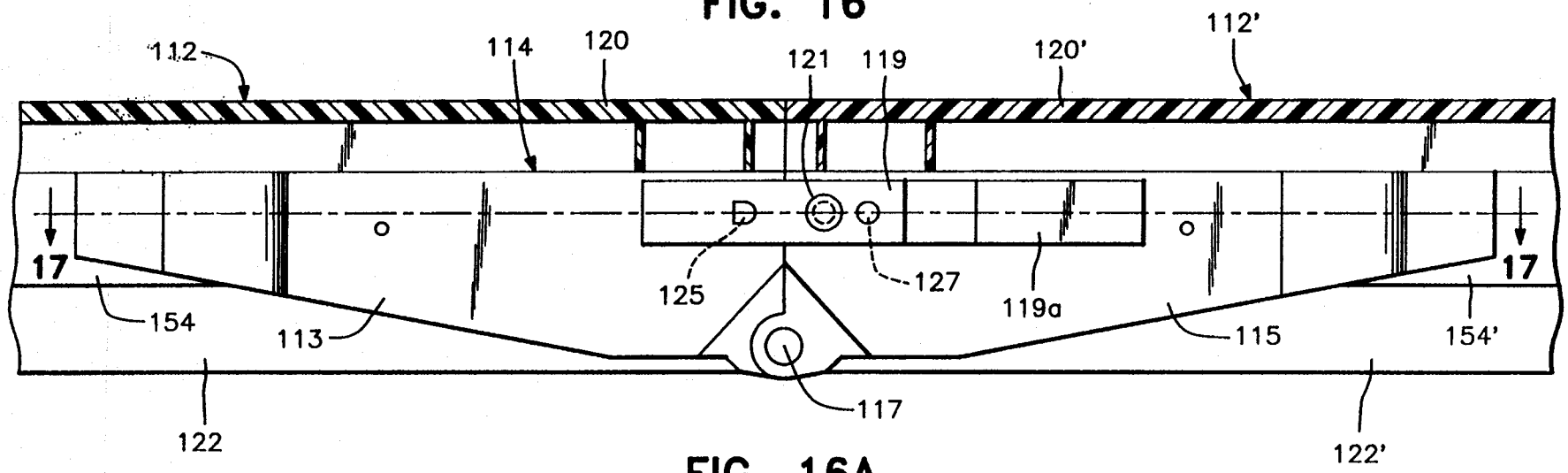
FIG. 16 is an enlarged sectional view on line 16—16 of FIG. 15 showing a spring latch in latched position.
Figure 16A:
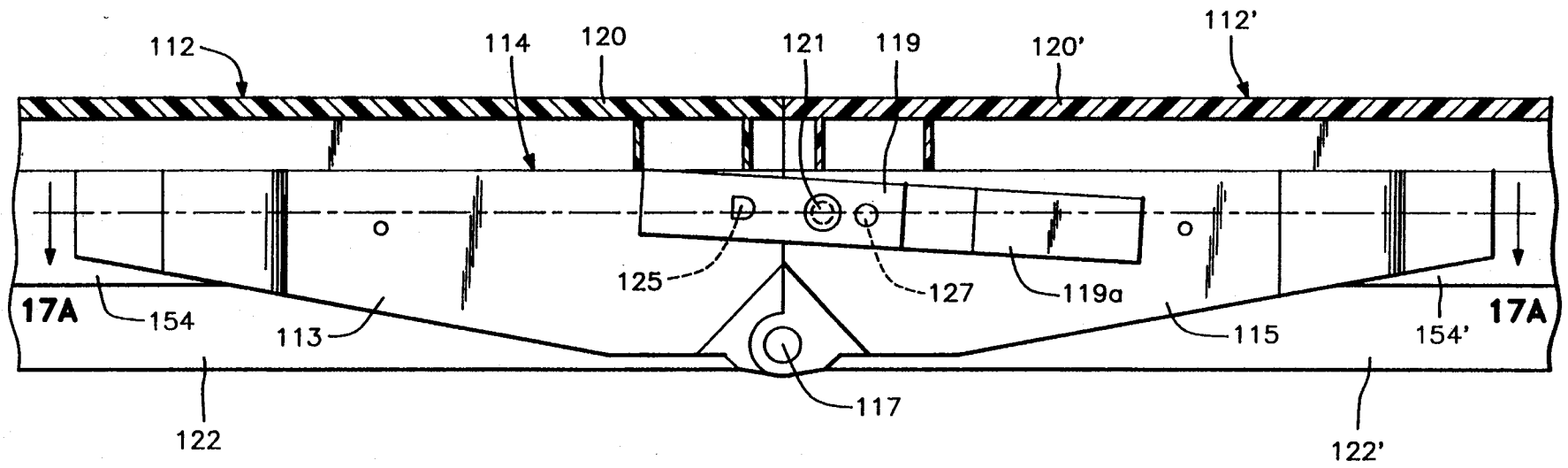
FIG. 16A is a view similar to FIG. 16 showing the latch released.

Operatively carried at the inner end of hinge plate 115 is a lever latch 119. The latch is pivotally mounted on a post 121 with a compression spring 123 urging the latch downwardly. On its undersurface, the latch has a pair of projecting lugs 125, 127 adapted to fit in corresponding apertures 129, 131 in hinge plates 113, 115. When the table is opened out as shown in FIGS. 15, 16 and 17, the lugs 125, 127 snap into the apertures 129, 131 and the table is latched open. To fold up the table end portion **119*a* of the latch is depressed, see FIG. 17A, removing lug 125 from apertures 129** and allowing the table to fold. Another like latch arrangement can be provided, if required, on the opposite side of the table.

As in the previous embodiment, the innermost ends of the longitudinal reinforcing bars 154, 154' and 156, 156', extend over and hold in place transverse reinforcing bars 152, 152' at the inner ends of the respective table top halves, see FIG. 15. Again, the transverse bars are located in pockets molded in the table top halves, or gaps in the latticework of ribs 126. In this embodiment, the bars 154, 154' also fit over and clamp in place the previously referred to transverse reinforcing bars 141, 141'.

Figure 21A:
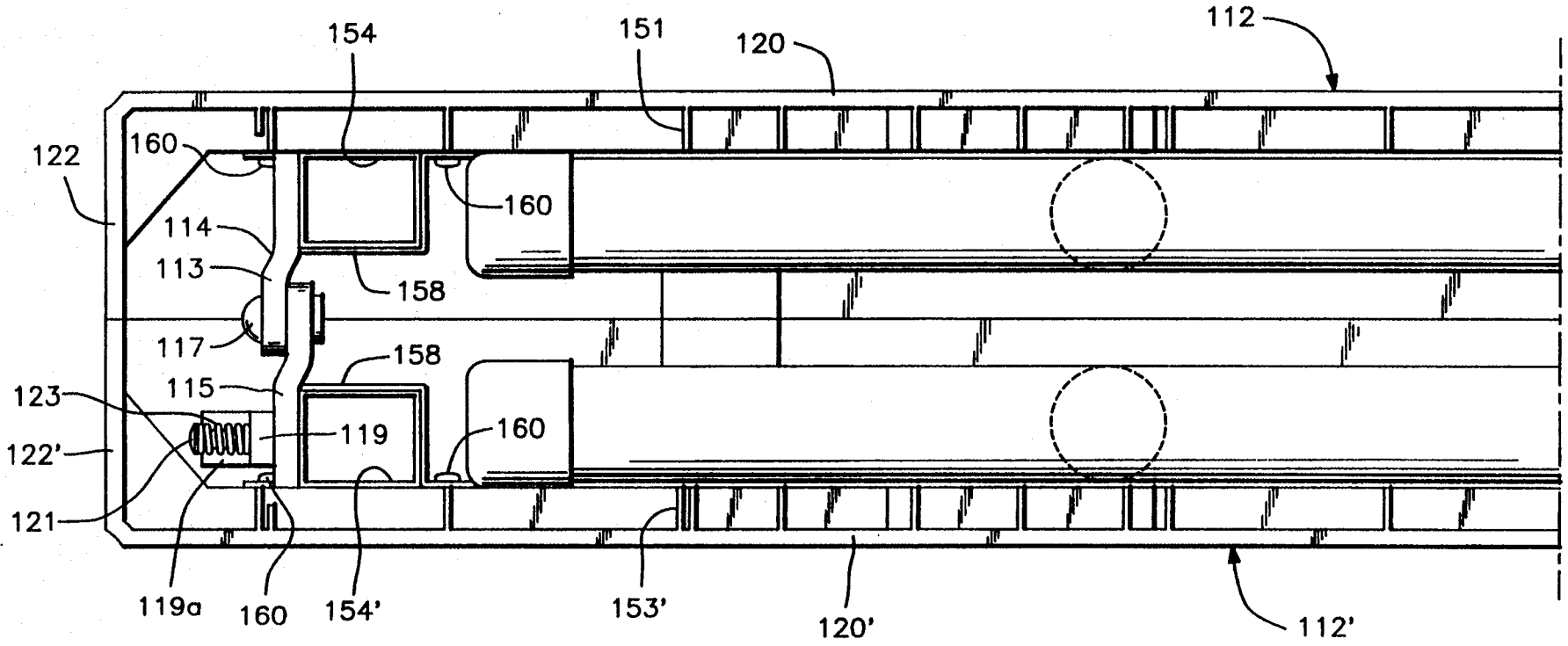
FIGS. 21A and 21B are respective sides of an enlarged end elevational view of the second embodiment table in the folded position as seen from the left hand side of FIG. 14.
Figure 21B:
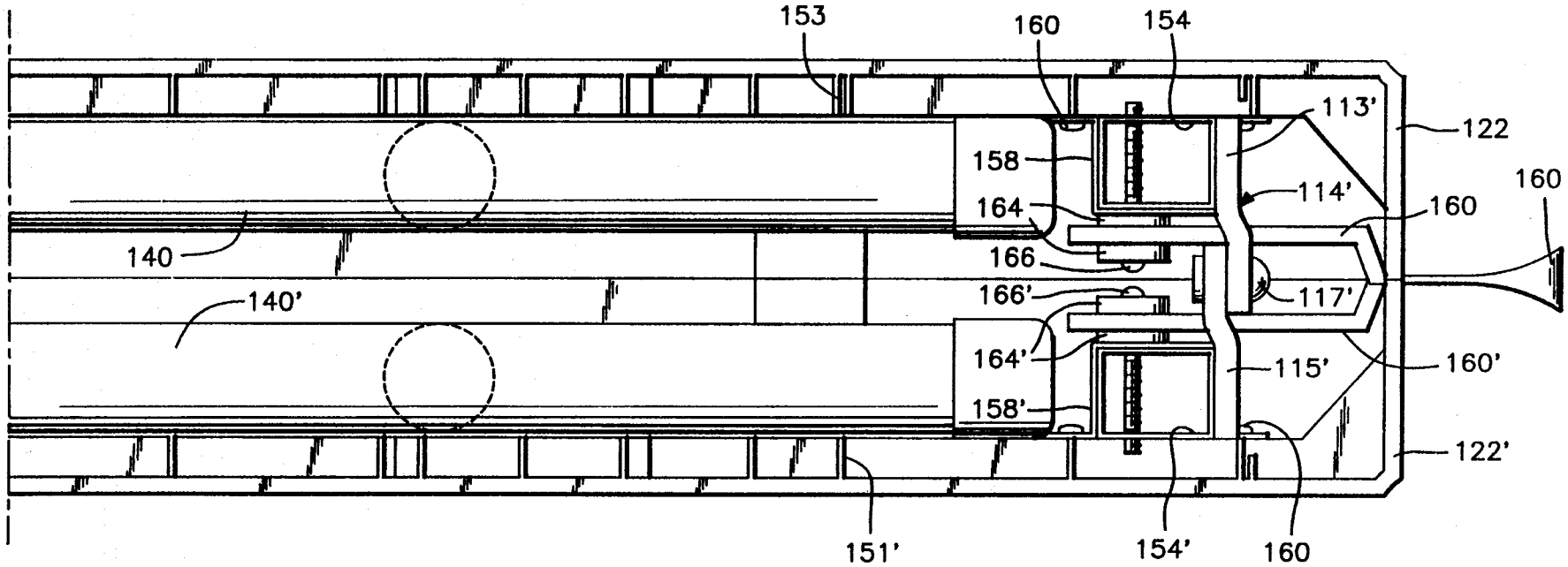

As seen in FIGS. 21B and 21A, the inner edges of the table top halves may be molded with projecting ribs 151, 151' and aligned pockets 153, 153' which receive the ribs when the table is opened out to provide a lateral locating and stabilization means for the table top halves precluding relative lateral displacement thereof when the table is open.

For carrying the table when it is folded closed, there are provided a pair of U-shaped sliding handles 160, 160', see FIGS. 14, 15 and 21A, made of somewhat flexible plastic. The legs of the handles are flattened and have slots 162, 162' received with a friction fit between resilient washers 164, 164' on posts 166, 166' threaded into the longitudinal reinforcing bars 156, 156'. The handles can thus slide, as shown by the arrows in FIG. 15, inwardly of the table when it is opened out and outwardly when the table is to be folded so as to fit between the table top halves, for carrying the table. Also, handle 160' is narrower than handle 160 to the extent that it nests neatly and snugly inside of handle 160 when the table is folded, see FIG. 14, to improve user comfort when carrying the table. This handle structure is used when the dimensions of the table make it easier to carry from the side rather than the end as in the first embodiment.

While only preferred embodiments of the invention has been described herein in detail, the invention is not limited thereby and modifications can be made within the scope of the attached claims.

I claim:

1. A folding table comprising a table top formed of a pair of table top halves, a pair of hinge assemblies securing the table top halves together along a transverse center line of the table for folding the table top halves together into a closed position in which the table top halves are substantially juxtaposed in adjacent planes and an open position in which the table top halves are substantially coplanar, and folding leg assemblies attached to undersurfaces of the respective table top halves, wherein each hinge assembly comprises a first hinge plate secured to one of the table top halves, a second hinge plate secured to the other of the table top halves and a hinge pin connecting the plates, and wherein at least one of the hinge assemblies includes a latching mechanism for latching the table in the open position, said latching mechanism comprising a pin extending from the first hinge plate, a latching lever mounted on the pin, spring means on the pin urging the latching lever toward the first hinge plate, latching apertures in the first and second hinge plates, corresponding latching projections on the latching lever adapted to fit in said apertures when the table is opened for latching the table in the open position, and a manually depressible extension on the latching lever for manipulating the lever to release the projections from the apertures when the table is to be folded.

2. A table as defined in claim 1, wherein the table top halves comprise plastic tray-like mouldings with longitudinal metal reinforcing bars and the hinge plates are welded to adjacent inner ends of respective pairs of the reinforcing bars.

3. A table as defined in claim 2, wherein the reinforcing bars are each secured to a surface of the respective table top half by plural spaced strap members screwed into the table top half and wherein the hinge plates each have a looped bridge portion to accommodate one of the strap members.

* * * * *